US006761342B1

(12) United States Patent
Giefer et al.

(10) Patent No.: US 6,761,342 B1
(45) Date of Patent: Jul. 13, 2004

(54) SLIP-RING CABLE COUPLER SYSTEM

(75) Inventors: Sebastian Giefer, Montecito, CA (US); Hugo Napier, Los Angeles, CA (US)

(73) Assignee: Reutlinger USA, Inc., Carpinteria, CA (US)

( * ) Notice: Subject to any disclaimer, the term of this patent is extended or adjusted under 35 U.S.C. 154(b) by 0 days.

(21) Appl. No.: 10/356,987

(22) Filed: Feb. 3, 2003

(51) Int. Cl.[7] ..... B42F 13/00; E04B 2/00

(52) U.S. Cl. ..... 248/343; 362/403; 248/328; 248/336

(58) Field of Search ..... 248/343, 328, 248/327, 320, 321, 323, 336, 337, 342, 344, 59, 317; 362/403; 52/506.07, 714

(56) References Cited

U.S. PATENT DOCUMENTS

| | | | | |
|---|---|---|---|---|
| 1,391,611 A | | 9/1921 | Butler | |
| 1,606,873 A | | 11/1926 | Gamache et al. | |
| 2,762,598 A | * | 9/1956 | Runge | 248/327 |
| 2,916,309 A | * | 12/1959 | Wolar | 285/86 |
| 3,072,989 A | | 1/1963 | Jugle et al. | |
| 3,512,743 A | * | 5/1970 | Lipscomb | 248/324 |
| 4,083,618 A | | 4/1978 | Busch, Jr. | |
| 4,141,117 A | | 2/1979 | Van Gompel | |
| 4,278,224 A | | 7/1981 | Arakawa | |
| 4,595,969 A | * | 6/1986 | McNair | 362/217 |
| 4,656,698 A | | 4/1987 | Arakawa | |
| 4,999,748 A | * | 3/1991 | Aoshika | 362/147 |
| 5,020,296 A | * | 6/1991 | Aoshika | 52/741.1 |
| 5,058,847 A | | 10/1991 | Arakawa | |
| 5,147,145 A | | 9/1992 | Facey et al. | |
| 5,162,612 A | | 11/1992 | Naka et al. | |
| 5,272,281 A | | 12/1993 | Bouley | |
| 5,317,493 A | * | 5/1994 | Muller et al. | 362/407 |
| 5,417,400 A | * | 5/1995 | Arakawa | 248/323 |
| 5,556,289 A | | 9/1996 | Holbrook, Jr. | |
| 5,690,424 A | * | 11/1997 | Warshauer et al. | 362/373 |
| 6,089,733 A | * | 7/2000 | Chen | 362/407 |
| 6,360,507 B1 | * | 3/2002 | Nevers et al. | 52/506.07 |
| 6,464,179 B1 | * | 10/2002 | Bulvan et al. | 248/58 |
| 6,517,222 B1 | * | 2/2003 | Orlov | 362/391 |

FOREIGN PATENT DOCUMENTS

| | | |
|---|---|---|
| DE | G 85 20 830.2 | 10/1985 |
| DE | G 87 16 482.5 | 8/1988 |
| DE | G 90 01 745.5 | 5/1990 |
| EP | 0 296 537 A2 | 12/1988 |
| GB | 1782 | 1/1913 |

OTHER PUBLICATIONS

The Griplock Glider by The Reutlinger Engineering Company, copyright 1997.

European Patent Office Communication dated Mar. 3, 1992 with Search Report in regard to EP 91 11 9597.

* cited by examiner

*Primary Examiner*—Anita M. King
(74) *Attorney, Agent, or Firm*—Brinks Hofer Gilson & Lione

(57) ABSTRACT

A slip-ring device includes a cable, a stop-sleeve, a cable coupler, and a slip-ring. Preferably, the stop-sleeve is coupled to the cable. The cable coupler includes a hollow portion that can pass the cable and a surface having an opening sized to restrict an axial movement of the stop-sleeve. A slip-ring is coupled to the outer circumference of the hollow portion. A method of mounting a fixture to an enclosure includes inserting a portion of the cable through the cable coupler; coupling the cable coupler to the enclosure; positioning a canopy over the stem of the cable coupler; and fastening the canopy to the enclosure by threading the slip-ring to the cable coupler.

14 Claims, 14 Drawing Sheets

SLIP-RING CABLE COUPLER SYSTEM

FIELD OF THE INVENTION

This invention relates to a system and a method that suspends objects, and more particularly, to a system and a method that suspends a fixture.

BACKGROUND

There are no hard-and-fast rules for hanging fixtures. Many suspended light fixtures, for example, have installation instructions that describe a preferred method of installation. In some installations, electrical wiring must be mounted to the structural trusses or studs that support the fixtures. In other installations, power is drawn from an existing circuit.

A basic installation problem is just getting the fixtures mounted and the electrical wires connected properly. One way of installing these fixtures is to secure the fixtures to a ceiling, either by screwing into the ceiling joists, clamping into the trusses, or fastening toggle bolts and then wiring the fixtures using wiring nuts. Unfortunately when ceiling canopies are used, the electrical wiring must first be connected before the fixtures are secured to the ceiling. This means that a ladder or another means must be used to support the weight of the fixtures before power is connected. Often, power cords and electrical connections alone cannot support the weight of a fixture.

The time required to hang or to install fixtures can be significant on jobs involving uneven or sloping ceilings where the wiring and mounting of the fixtures are obstructed. Another basic problem with some installations are their inflexibility. In commercial settings, for example, lighting must be moved around to accommodate the installation of new machinery, ductwork, or different line layouts. In some installations these are not simple processes as the weight of the fixtures must first be supported, the power disconnected, and the installation processes repeated at new locations. When hung from tall ceilings the time and cost of these installations can be significant. It can also be very dangerous especially when a second installer is needed to support the weight of the fixtures as a first installer connects power to them.

SUMMARY

The present invention is defined by the following claims. This description summarizes some aspects of the present embodiments and should not be used to limit the claims.

A slip-ring embodiment comprises a cable, a stop-sleeve, a cable coupler, and a slip-ring. Preferably, the stop-sleeve is coupled to the cable. The cable coupler includes a hollow portion that can pass a cable and a surface having an opening sized to restrict axial movement of the stop-sleeve. A slip-ring is coupled to the outer circumference of the hollow portion.

A method of mounting a fixture to an enclosure includes inserting a portion of the cable through the cable coupler; coupling the cable coupler to the enclosure; positioning a canopy over the stem of the cable coupler; and fastening the canopy to the enclosure by threading the slip-ring to the cable coupler.

Further aspects and advantages of the invention are described below in conjunction with the present embodiments.

DETAILED DESCRIPTION OF THE PRESENT EMBODIMENTS

The present embodiments of the system and method provide a flexible coupling arrangement that can be easily configured and adjusted. When part of a lighting system, the flexible coupling system and method allows a light source to be easily installed. Preferably, moving the light source is just as simple. In one embodiment, the light source can be disconnected, moved to a new location, and installed by a single installer without using any tools.

Figure 1:
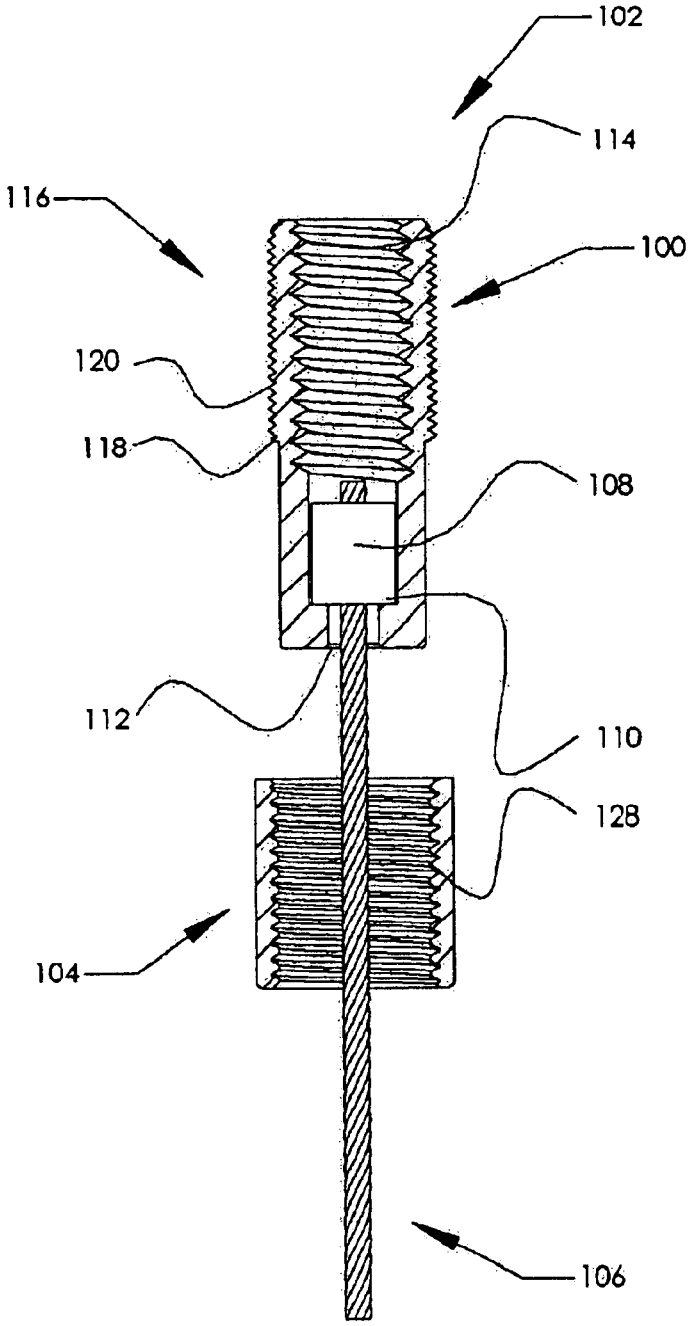
FIG. 1 is a front exploded view of an embodiment.
Figure 1A:
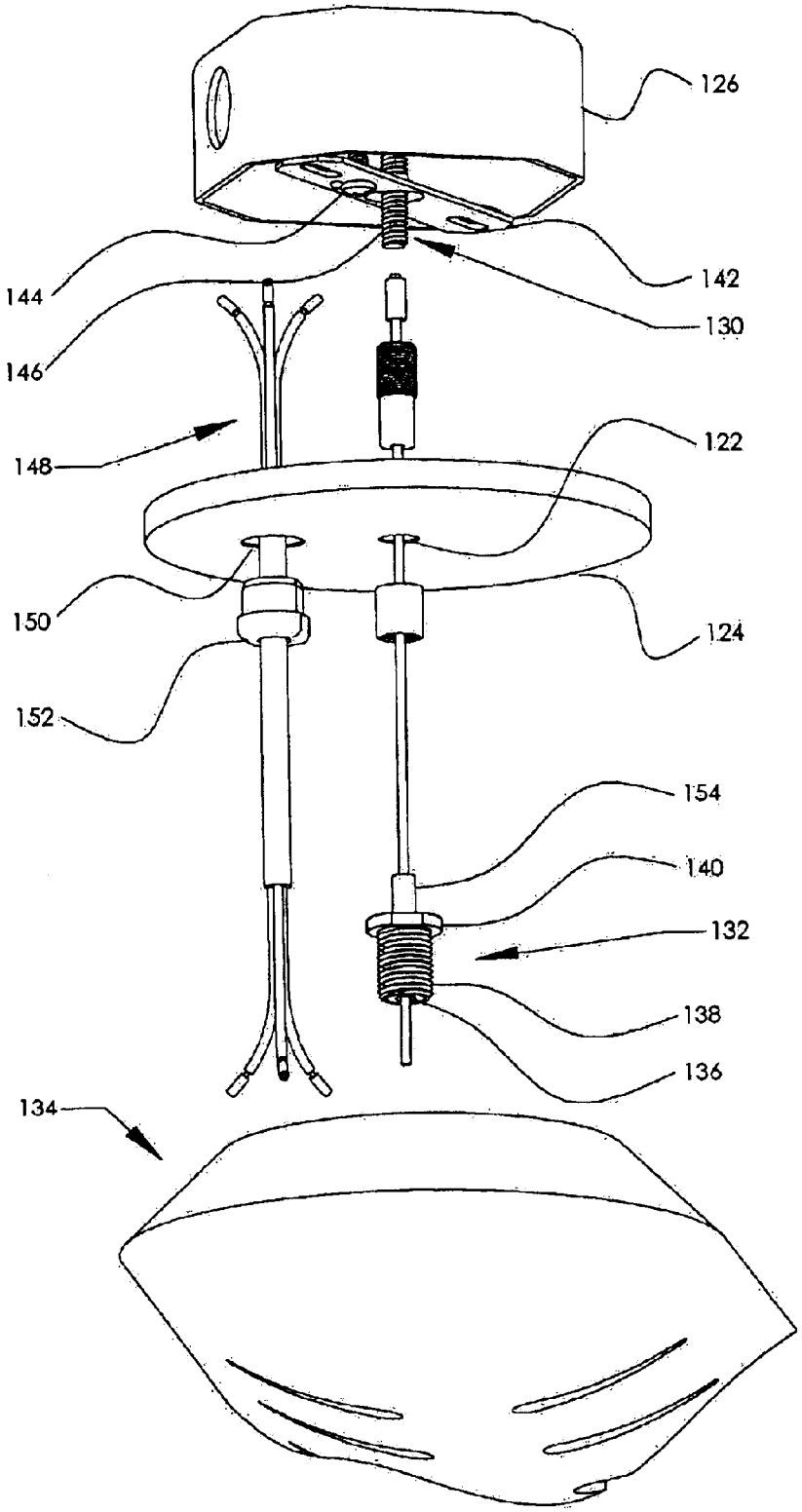
FIG. 1A is an exploded view of the embodiment of FIG. 1 as part of a lighting system.

FIGS. 1 and 1A shows a front exploded view of a slip-ring embodiment and an exploded view of the embodiment as part of a lighting system. The embodiments illustrate a cable coupler 102, a slip-ring 104, and a cable 106. Preferably, the cable 106 includes a stop-sleeve 108 at one end that prevents a downward or axial movement of the cable 106 when the stop-sleeve 108 engages a proximal inner surface 110 of the cable coupler 102. In the illustrated embodiment, the stop-sleeve 108 has a hollow cylindrical shape with an inner circumference substantially equal to the circumference of the cable 106 and an outer circumference greater than the circumference of an opening 112 passing through the proximal surface 110 of the cable coupler 102.

The cable coupler 102 includes a stem 100 comprised of a hollow housing illustrated as two hollow portions having different inner circumferences. From a distal end, spiral threads 114 are formed on the inner cylindrical surface of the first hollow portion. These female spiral threads 114 that can be tapered or rolled longitudinally extend from the distal end of the hollow housing to an intermediate position. Preferably, the threads 114 are fatigue resistant and uniformly sized to receive a threaded rod or stud 130. At the proximal end, the second hollow portion without threads includes an opening 112 sized to pass the cable 106 through the proximal wall but restrict a downward or axial movement of the stop-sleeve 108. In FIG. 1 the second hollow portion is shown in uniform cylindrical cross-section having smoothly curved surfaces connecting its open ends.

Male threads 116 are tapered or rolled on an outer portion of the cable coupler 102. Preferably, these spiral threads 116 extend longitudinally from the distal end of the hollow housing to an intermediate position. Although the uniform circumference of the flanks 118 is larger than the circumference of the second outer portion of the cable coupler 102, in an alternative embodiment the flanks 118 and the second outer portion have a substantially uniform outer circumference. Similarly, the sharp and planar flutes 120 of the threads 116 can be rounded into curved grooves so that there are no sharp corners in the threaded roots that might cause stress. In these embodiments, the outer circumferences of the stem 100 that includes the flanks 118 and the second outer portion is smaller than the circumference of a mounting hole 122 passing through a canopy 124. The illustrated canopy 124 is a protective cover that conceals an opening in an enclosure within which electrical circuits are connected. In some embodiments, the canopy 124 protects power and ground wires 148 within a junction box 126, in other embodiments the canopy 124 firmly holds the power and ground wires 148 in place.

In the illustrated embodiment, the slip-ring 104 having a smooth outer surface is used to firmly attach the canopy 124 to the junction box 126 without slippage. Preferably, the outer circumference of the slip-ring 104 is larger than the circumference of the mounting hole 122 passing through the canopy 124. The slip-ring 104 includes a hollow housing having a uniform inner circumference terminating at open ends of substantially equal diameter. Preferably, female mating threads 128 are formed on the inner cylindrical surface of the housing. These spiral threads 128 that can be tapered or rolled extend longitudinally from one open end of the housing to the other open end. Preferably, the threads 128 are fatigue resistant and uniformly sized to receive and engage the male threads 116 formed on the outer surface of the cable coupler 102. By this engagement, preferably the canopy 124 is secured to the junction box 126.

The slip-ring embodiment also includes a cable 106. In the illustrated embodiment the cable 106 is a suspension cable such as an aircraft cable galvanized to prevent rust. Preferably, one end of the cable 106 terminates at the stop-sleeve 108 that is supported by the substantially planar proximal inner surface 110 of the cable coupler 102. A load balancing can be achieved by coupling the cable coupler 102 to a threaded rod or stud 130. When part of a suspension system, a cable gripper 132 can be attached to an object such as a light source 134 by the cable 106.

In the illustrated embodiment, the cable gripper 132 includes a hollow housing terminating at a self-locking quick release plunger 154 and at an open end 136. Preferably, the inner circumference of the cable gripper 132 is sized to pass the cable 106 received by the self-locking plunger 154. Female spiral threads 138 are tapered or rolled on an outer portion of the cable gripper 132 for connecting a suspended object such as a light source 134 to the cable 106. In the illustrated embodiment, the light source 134 can be attached to the cable gripper 132 by driving the cable gripper 132 into a housing of the light source 134. The cable gripper 132 is mounted to the light source 134 when an outer surface of the light fixture presses against a key flange 140. A vertical adjustment can be accomplished by biasing the quick release plunger 154 toward the key flange 140 and sliding the cable 106 through the cable gripper 132. In this embodiment, excess cable 106 that is fed out of the housing at a proximal end can be cut or left inside the fixture for future height adjustments. Once adjusted, releasing the bias on the quick release plunger 154 locks or secures the light source 134 to the cable 106.

One way of suspending a light source 134 is to connect the light source 134 to a junction box 126 that is coupled to an elevated surface such as a ceiling. As shown in FIG. 1 a bracket bar 142 having a stud 130 and a ground connection 144 is connected to the junction box 126. Preferably, the male spiral threads 146 of the stud 130 can form a threaded joint with the female spiral threads 114 of the cable coupler 102. Before a threaded joint is formed, the cable 106 is fed through the cable coupler 102 until the stop-sleeve 108 seats against the inner proximal surface 110 of the proximal wall of the cable coupler 102. Once seated, the cable coupler 102 is connected to the stud 130 that is threaded to the inner threads 114 of the cable coupler 102. Preferably, the stud 130, the stop-sleeve 108, and the cable 106 are axially aligned along a central axis passing through the first and second hollow portions of the cable coupler 102.

Preferably, the cable 106 is fed through the mounting hole 122 of the canopy 124 and the hollow housings of the slip-ring 104 and the cable griper 132. In this embodiment, the cable gripper 132 is mounted to the light source 134 by a threaded joint. Once suspended by the cable 106, power and ground wires 148 from the light source 134 can be fed through the power feed hole 150 passing through the canopy 124 and connected to the feed wires sourcing power. Preferably, a bushing 152 having a portion that can pass through the power feed hole 150 can provide strain relief. With the power connected and the wires folded into the junction box 126, the canopy 124 is secured to the junction box 126 by feeding the stem 100 of the cable coupler 102 through the mounting hole 122 of the canopy 124 and tightening the slip-ring 104 around the cable coupler 102 by a hand pressure. In this embodiment as the slip-ring 104 is threaded to the cable coupler 102, the canopy 124 is tightened to the junction box 126 without leaving any gaps between the canopy 124 and the slip-ring 104, and in some embodiments, the elevated surface. As such, the slip-ring embodiment can provide a second electrical ground to an electrical fixture such as the illustrated light source 134.

Figure 2:
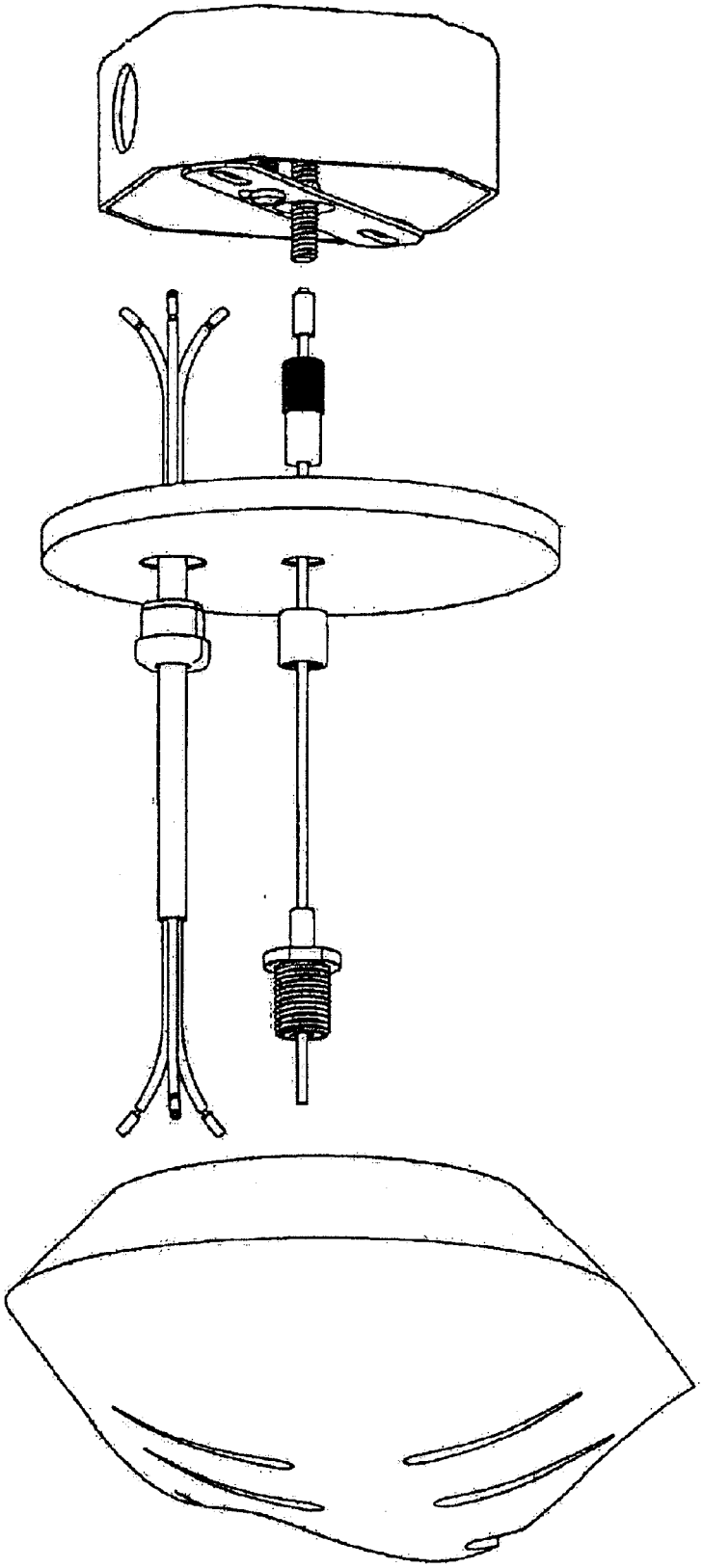
FIG. 2 is a second front view of the embodiments of FIG. 1A.
Figure 2A:
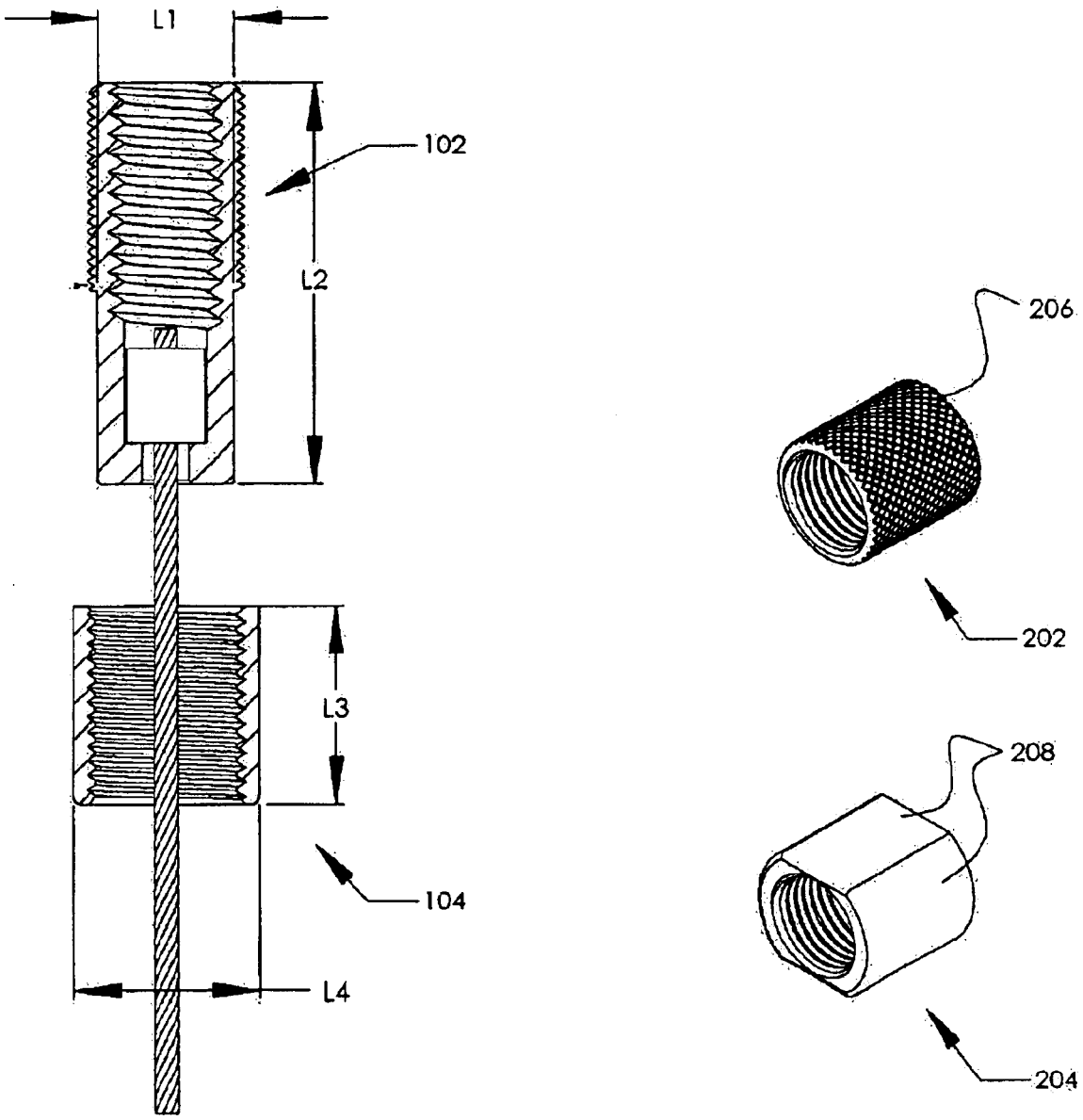
FIG. 2A is enlarged views of alternative slip-ring embodiments.
Figure 3:
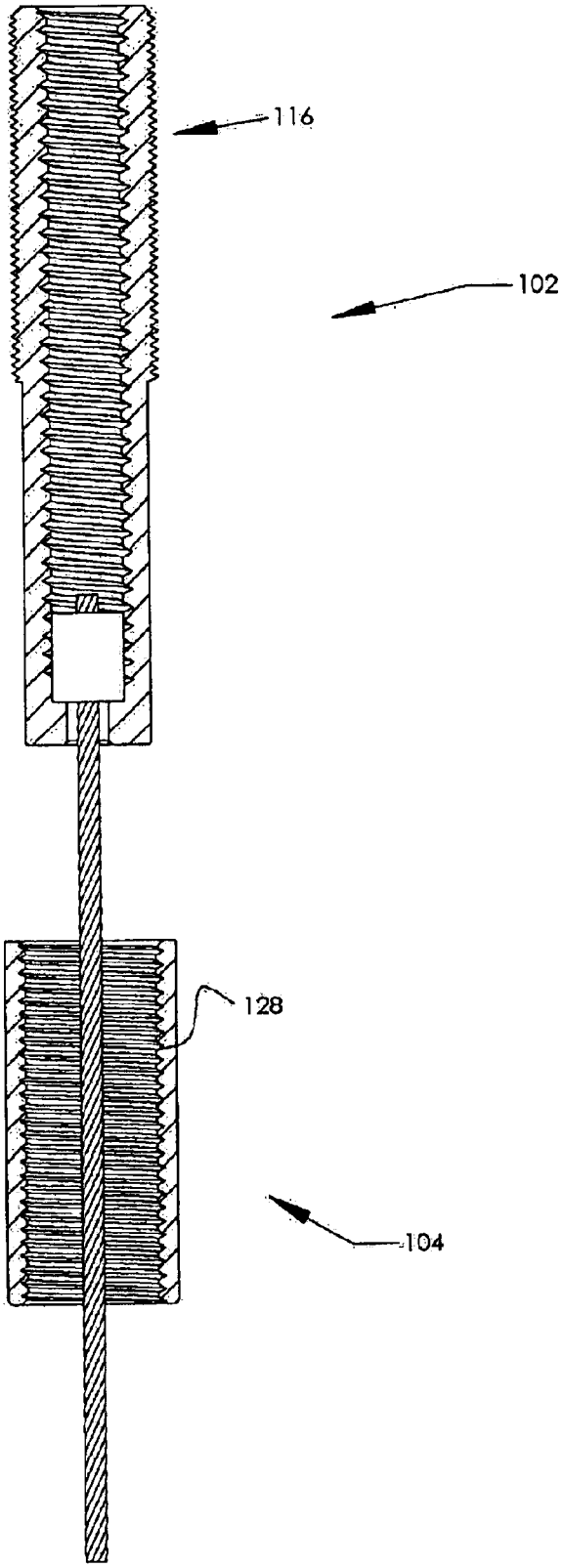
FIG. 3 is a front exploded view of a second embodiment.
Figure 3A:
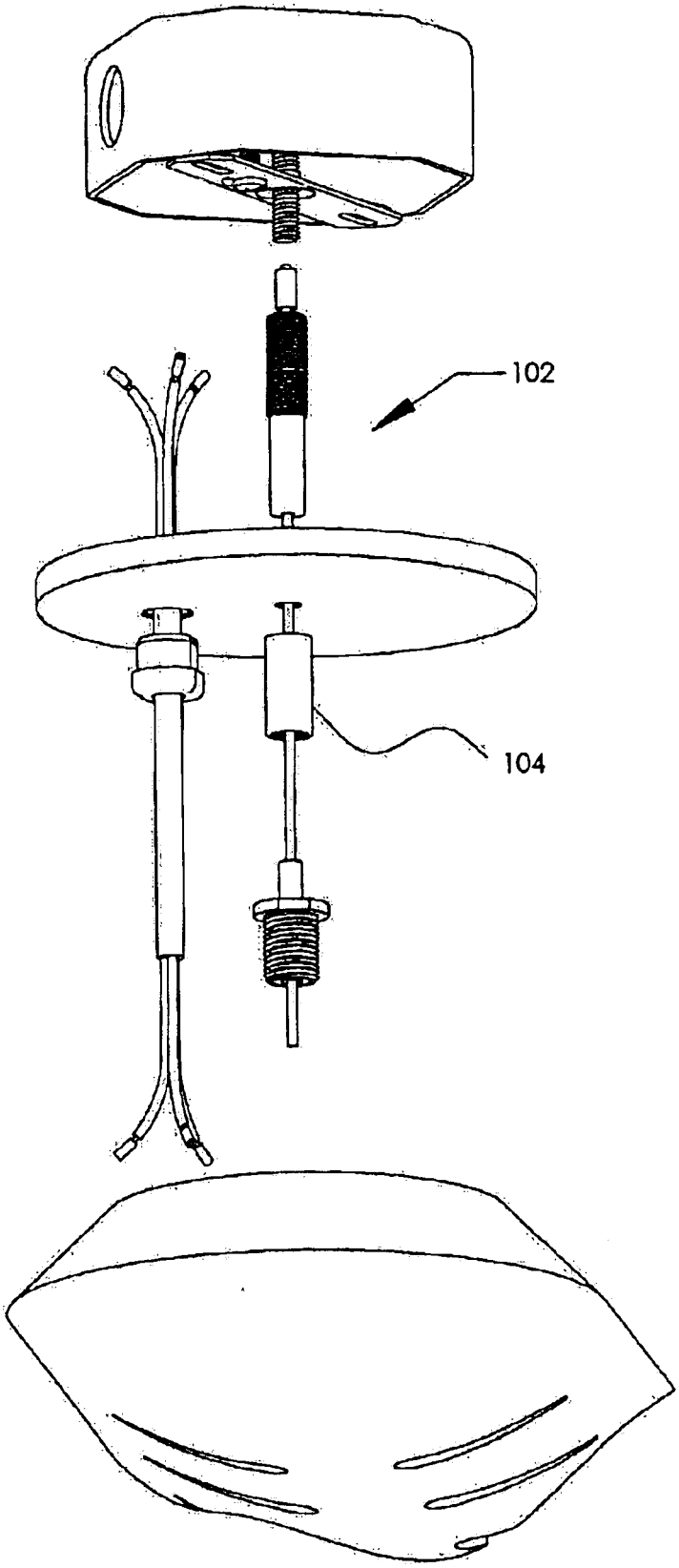
FIG. 3A is an exploded view of the embodiment of FIG. 3 coupled to part of a lighting system.

Although the embodiments are not limited to specific dimensions, FIGS. 2 and 2A illustrates the exemplary dimensions of a first embodiment. Preferably, L1 is the outer diameter of a second outer portion of a cable coupler. Preferably, L2 is the length of the cable coupler. Preferably, L3 is the length of a slip-ring. Preferably, L4 is the outer diameter of the slip-ring. In this exemplary embodiment, L1 is about 0.34 of an inch, L2 is about 1.02 inches, L3 is about 0.51 of an inch, and L4 is about 0.47 of an inch. Many other dimensions are also possible. As shown in FIGS. 3 and 3A, for example, lengthening the exterior spiral threads 116 of the cable coupler 102 and the inner spiral threads 128 of the slip-ring 104 are also alternative embodiments.

The slip-ring also can have many shapes and finishes. As shown in FIG. 2A the slip-ring 202 and 204 can have a cylindrical and a polygonal shape. Preferably, the coarse outer grid surface 206 that is part of the illustrated cylindrical shaped slip-ring 202 provides a non-slip surface that can be used to tighten the slip-ring 202 around the cable coupler 102 by a hand pressure. Alternatively, a hand pressure or a tool can tighten the planar and cylindrical outer surfaces 208 that are part of the illustrated polygonal shaped slip-ring 204. In this alternative embodiment, fixed or adjustable jaws of a wrench can be used to fasten the slip-ring 204 around the cable coupler 102.

Figure 4:
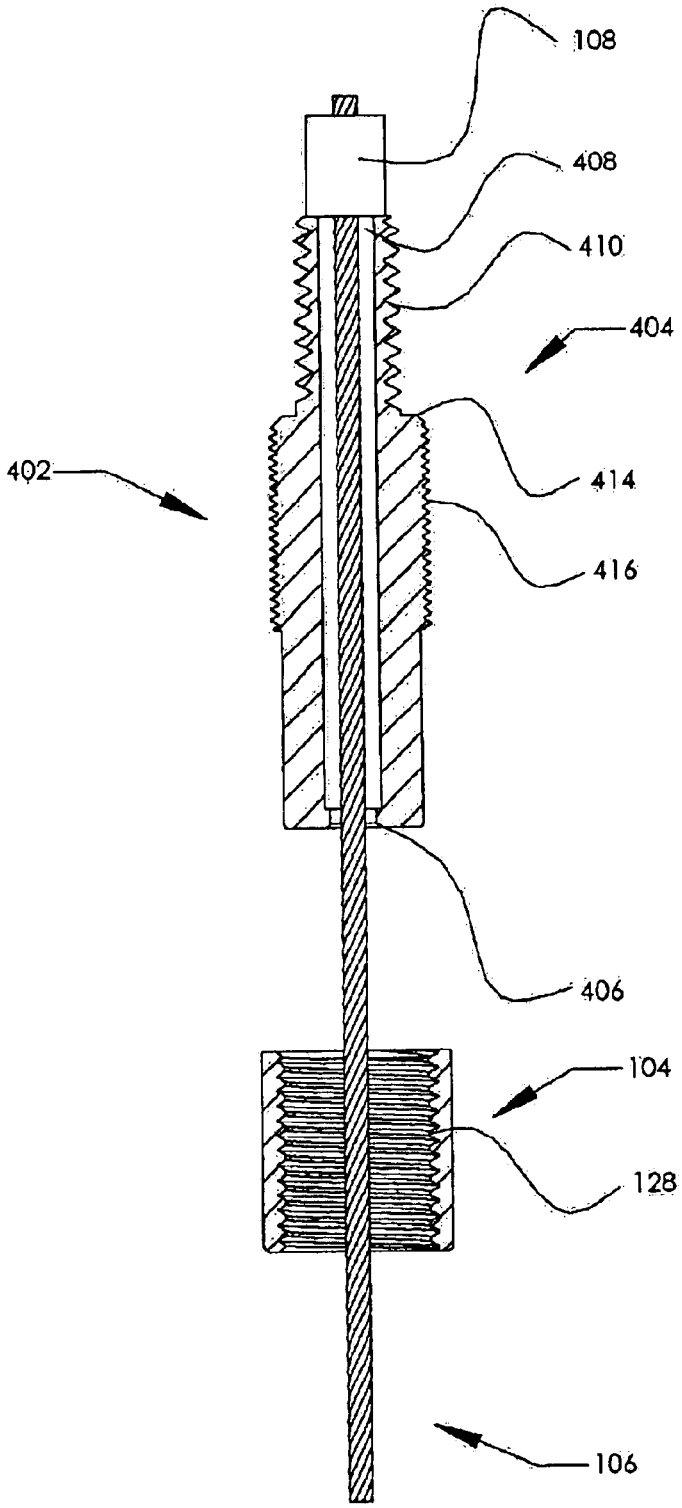
FIG. 4 is a front exploded view of a third embodiment.
Figure 4A:
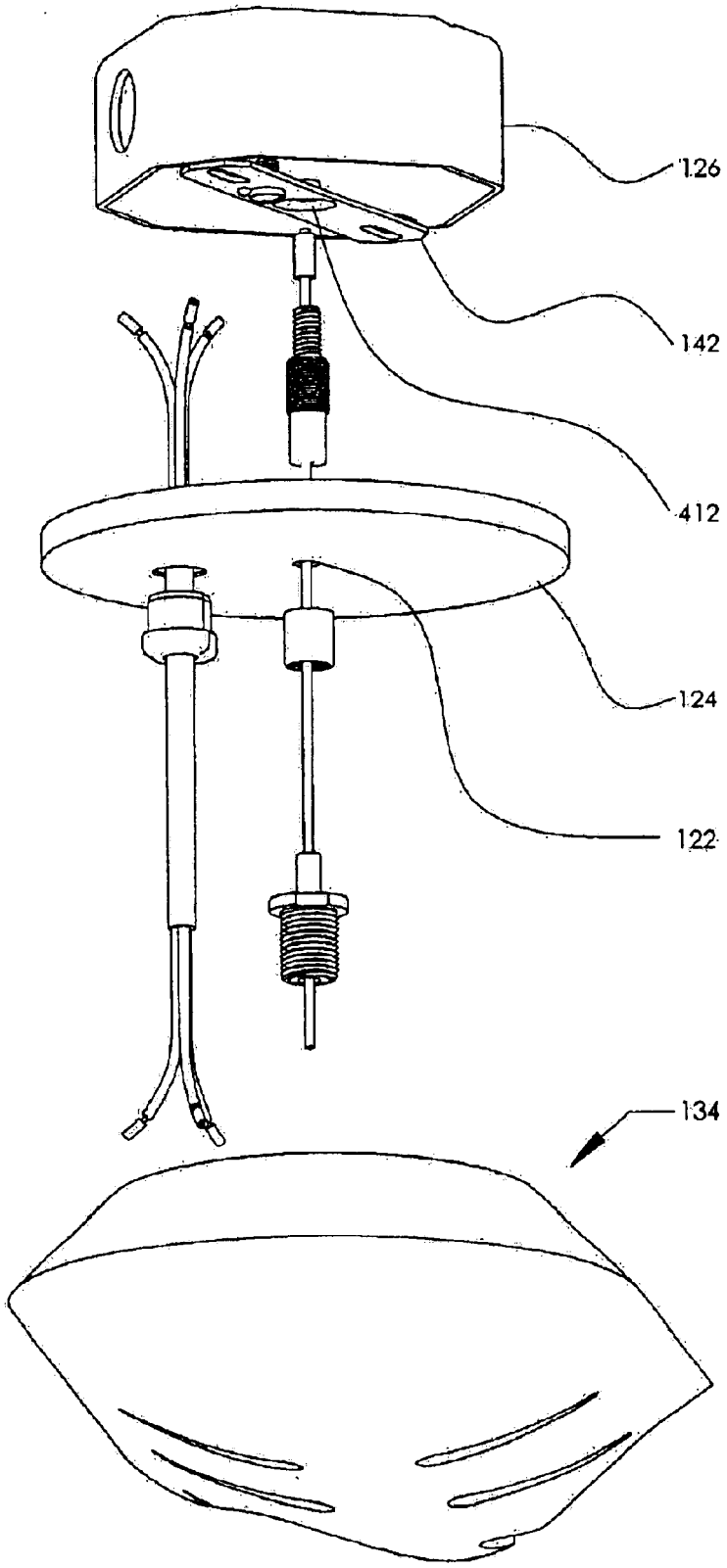
FIG. 4A is an exploded view of the embodiment of FIG. 4 coupled to part of a lighting system.
Figure 5:
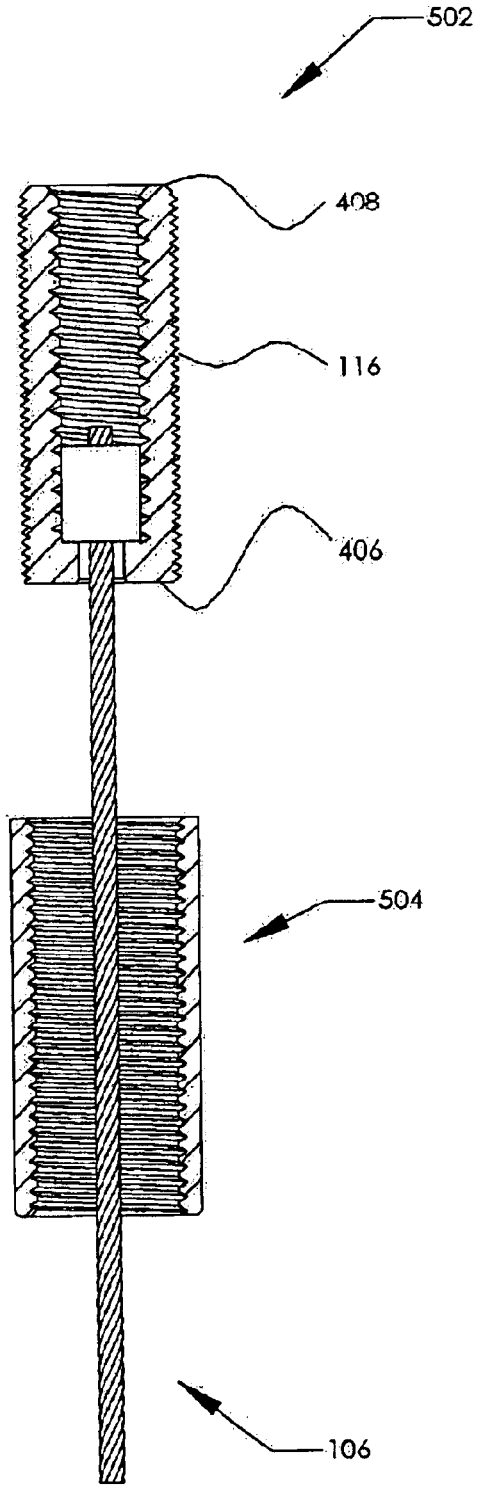
FIG. 5 is a front exploded view of a fourth embodiment.
Figure 5A:
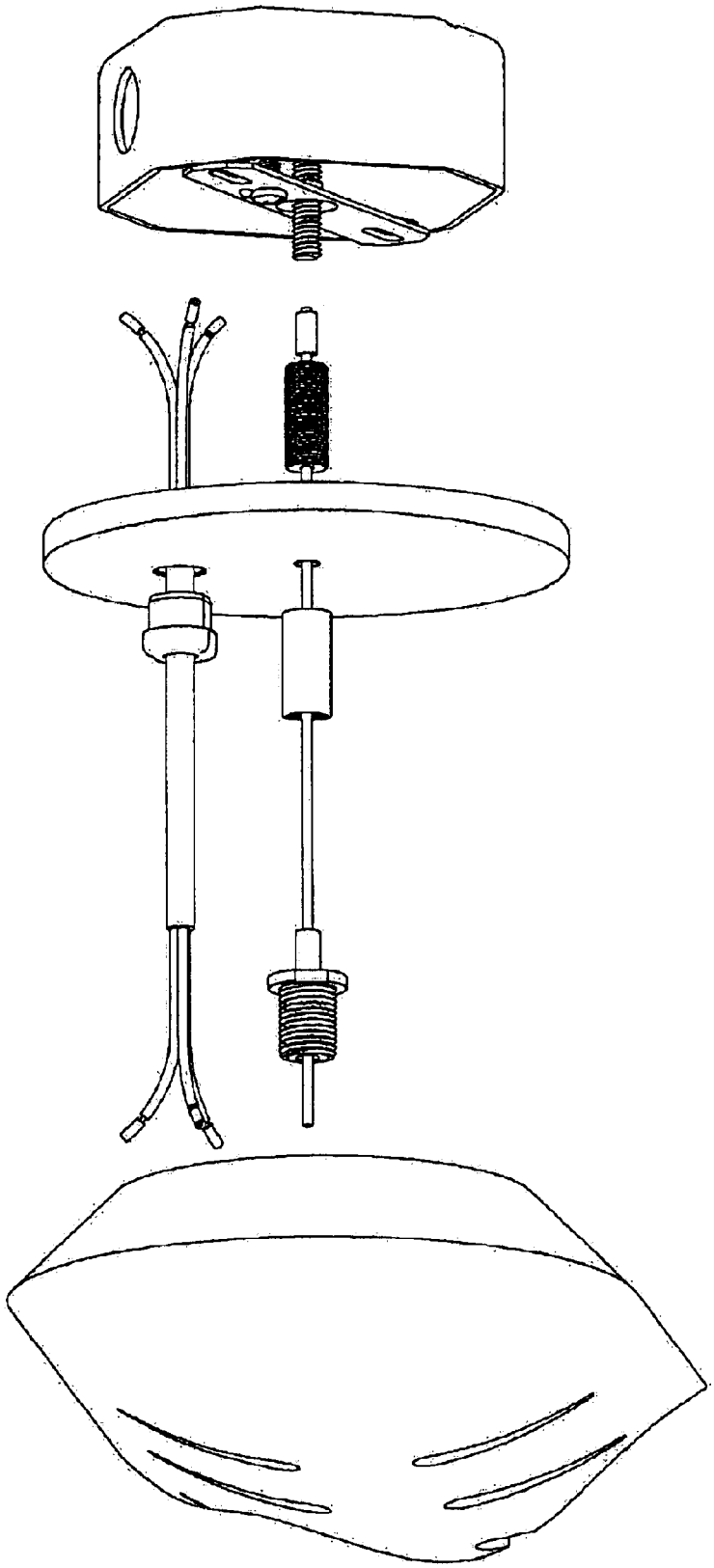
FIG. 5A is an exploded view of the embodiment of FIG. 5 coupled to part of a lighting system.

FIGS. 4 and 4A illustrates another slip-ring embodiment. Preferably, this embodiment includes a cable coupler 402, a slip-ring 104, and a cable 106. Preferably, the slip-ring 104, cable 106, and stop-sleeve 108 of this embodiment have the same structure as the slip-ring 104, cable 106, and stop-sleeve 108 described above. The different geometrical structure of the cable coupler 402 in this embodiment, however, can replace the cable coupler 102 and stud 130 of the first embodiment without losing any mechanical or functional properties.

Preferably, the cable coupler 402 shown in FIGS. 4 and 4A includes a stem 404 comprised of a hollow housing. In this embodiment, the hollow housing is shown in uniform cylindrical cross-section having smoothly curved surfaces that extend from its open ends. Although the open ends can have a substantially uniform circumference, in this embodiment the opening in the proximal end 406 is smaller than the opening in the distal end 408. Preferably, the opening in the proximal end 406 is sized to pass the cable 106 while the opening in the distal end 408 is sized to restrict a downward or axial movement of the stop-sleeve 108.

Preferably, male threads 410 and 416 are tapered or rolled on separate outer portions of the cable coupler 404 having different circumferences. From the distal end 408, spiral threads 410 are formed on the outer cylindrical surface of a first outer portion. Preferably, the threads 410 extend longitudinally from the distal end 408 to an intermediate position. In this embodiment, the male threads 410 form a threaded joint when threaded through a mounting hole 412 passing through the bracket bar 142. Preferably, a flange 414 or transition separates the smaller circumference of the first outer portion from the larger circumference of the second outer portion. Near an intermediate position, spiral threads 416 are also formed on the outer cylindrical surface of the second outer portion. These male threads 416 extend longitudinally toward the proximal end 406 and can form a threaded joint when threaded into the inner female mating threads 128 of the slip-ring 104. Like the first embodiment, the sharp and planar flutes of the threads 410 and 416 can be rounded into curved grooves so there are no sharp corners in the threaded roots.

In the illustrated embodiment, preferably the outer circumference of the stem 404 comprised of the first and second outer portions is smaller than the circumference of the mounting hole 122 passing through the canopy 124. Also, the outer circumference of the slip-ring 104 is preferably greater than the circumference of the mounting hole 122 of the canopy 124. By this structure, the canopy 124 can be lowered from a junction box 126 while the cable coupler 402 and cable 106 support the weight of a suspended object such as the illustrated light source 134. When the slip-ring 104 is threaded to the cable coupler 404, the canopy 124 is tightened to the junction box 126 or another enclosure.

One way of suspending a light source 134 using this embodiment is to connect the cable coupler 404 to the bracket bar 142 that can comprise a T-bar clip. Before a threaded joint is formed, preferably the cable 106 is fed through the cable coupler 404 until the stop-sleeve 108 seats against the outer circumference and/or outer surface of the distal end of the cable coupler 404. Once seated, the cable coupler 404 is connected to the bracket bar 142 by threading the first outer portion of the cable coupler 404 into the mounting hole 412 of the bracket bar 142. Preferably, the outer circumference of the stop-sleeve 108 is smaller than the circumference of the mounting hole 412 passing through the bracket bar 142. In this embodiment, when the cable coupler 404 forms a threaded joint with the mounting hole 412 without a threaded rod or stud 130, preferably at least a portion of the stop-sleeve 108 is positioned above the bracket bar 142, and in some embodiments, within the junction box 126 or an enclosure. Once coupled to the bracket bar 142, the slip-ring embodiment can be coupled to a suspension assembly, linear or other fixtures, or as described, the light source 134.

Figure 7:
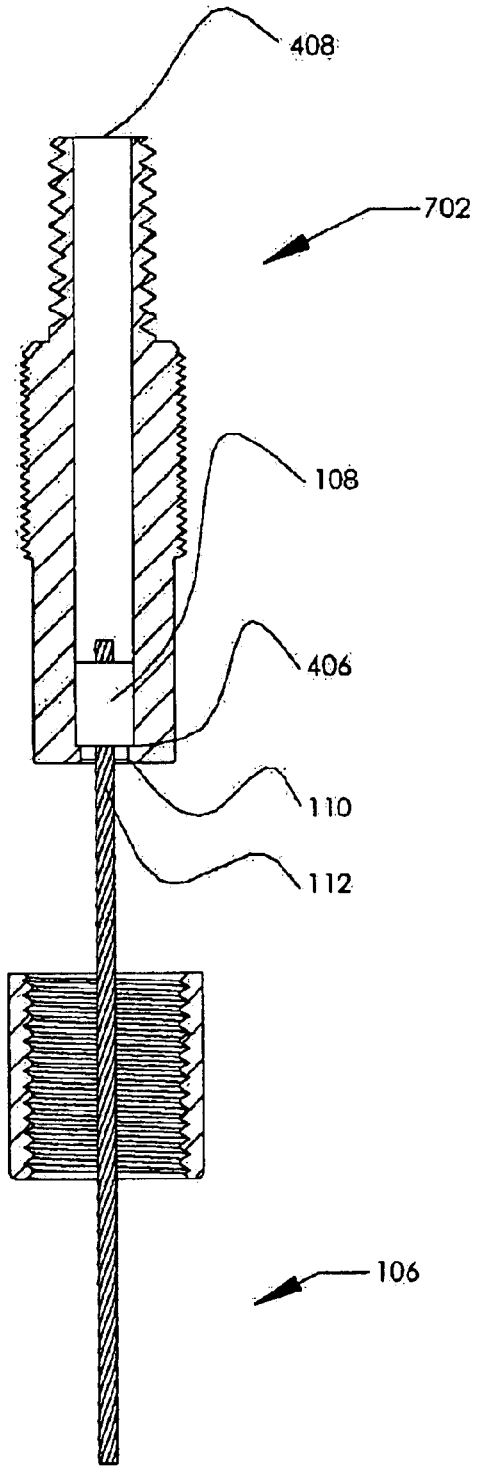
FIG. 7 is a front exploded view of a sixth embodiment.
Figure 7A:
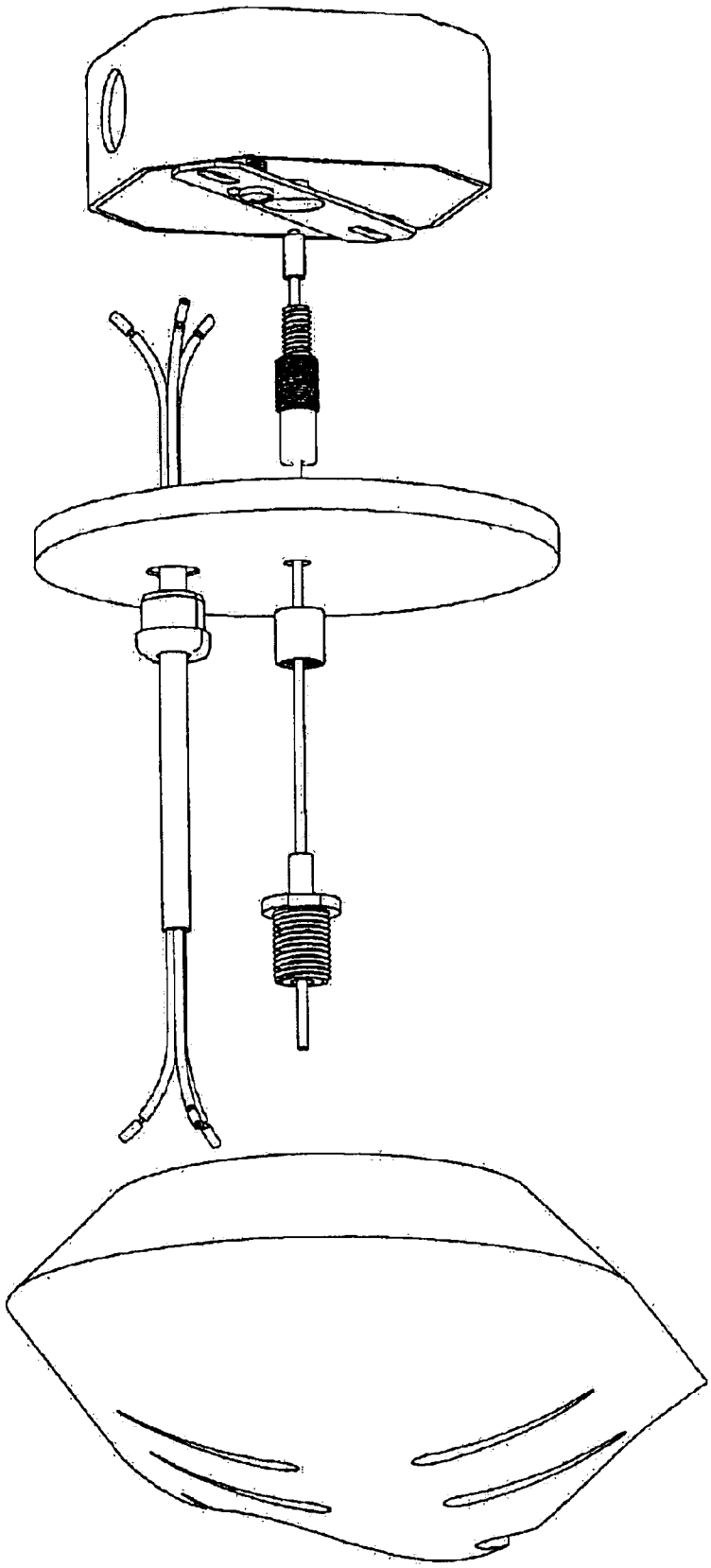
FIG. 7A is an exploded view of the embodiment of FIG. 7 coupled to part of a lighting system.

FIG. 7 shows an alternative cable coupler 702 to the cable coupler 402 shown in FIG. 4. In this embodiment, the uniform circumference of the hollow opening passing from the distal to proximal end is sized to pass the outer circumference of the stop-sleeve 408. At the proximal end 406, an opening 112 passing through the proximal surface 110 is sized to pass the cable 106 while limiting a downward or axial movement of the stop-sleeve 108 when the stop-sleeve 108 is pressing against the proximal surface 110. In this embodiment, the stop-sleeve 108 is captive within the cable coupler 702.

Figure 6:
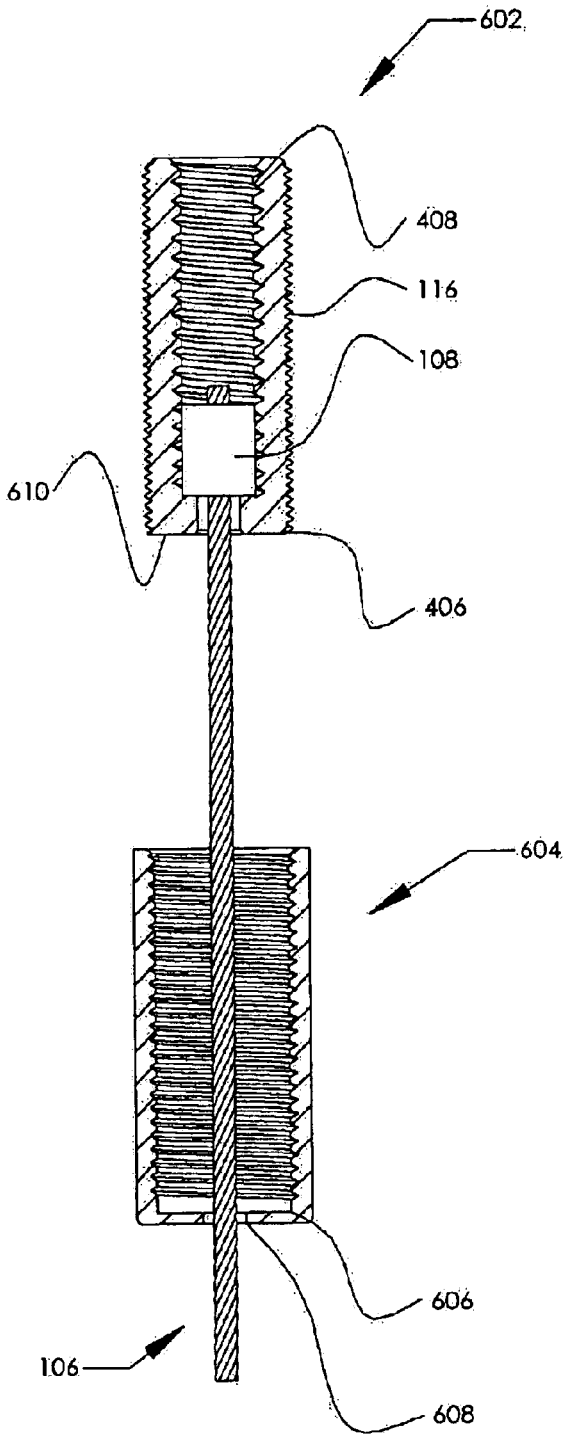
FIG. 6 is a front exploded view of a fifth embodiment.
Figure 6A:
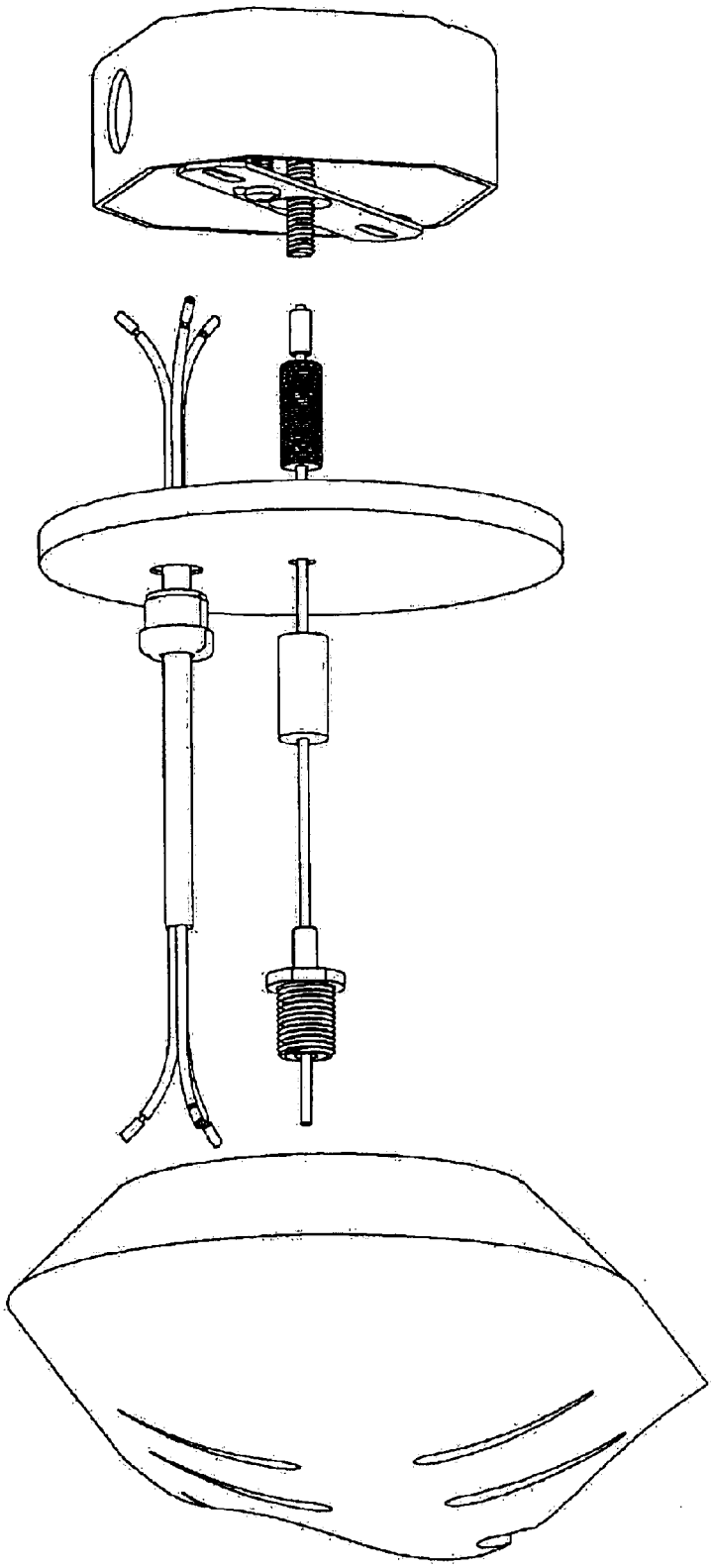
FIG. 6A is an exploded view of the embodiment of FIG. 6 coupled to part of a lighting system.

Many other alternative embodiments are also possible. For example, the male threads 116 that are formed on the outer portion of the cable couplers 502 and 602 shown in FIGS. 5, 5A, 6 and 6A can extend from end-to-end from the proximal 406 to the distal end 408. In this embodiment, a stronger threaded joint is formed by the cable couplers 502 and 602 and slip-rings 504 and 604, respectively, by the additional threaded engagements. In another alternative embodiment, the proximal end of the slip-ring 604 is enclosed by a top 606 having an aperture 608 through which the cable 106 can also pass through. In the illustrated embodiments of FIG. 6 and 6A, when the slip-ring 604 is threaded to the cable coupler 602, preferably the top 606 seats against the outer proximal surface 610 of the cable coupler 602. Preferably, this arrangement supplements the load bearing strength of the cable coupler 602 by providing a second limiting wall that restricts the downward or axial movement of the stop-sleeve 108. Moreover, the top 608 can also prevent the stripping of threads by limiting the axial range of the slip-ring 604. When the inner surface of the top 608 presses against the outer proximal wall of the cable coupler 602, the slip-ring's 604 movement in a fastening direction (e.g., toward an enclosure such as a canopy, for example) is restrained. In the illustrated embodiment, the top is a unitary part of the slip-ring 604. In another embodiment, the top 606 is coupled to the slip-ring 604 by a fastener such as a keyway or threads, for example.

In an alternative embodiment that includes a cable gripper 132, cable 106 can be fed outward from the hollow housing of the cable gripper 132 through a side or bottom outlet. When the side outlet is used, excess cable is deflected from an axial center of the cable gripper housing by a curved channel. When connected to an object, such as a light source, preferably the cable is led out of the connector body above its distal end. In other embodiments, the cable is led out of the connector body above the joint that couples the cable gripper to a fixture or the light source 134.

The above described system and method provide an easy-to-install, reliable means of suspending one or more objects, such as a linear fixture or a line of locked fixtures. When part of an electrical device, the system and method allows a canopy to be removed from an enclosure or a junction box by unscrewing the slip-ring and allowing the canopy to drop over the stem of the stud and/or the cable coupler. The enclosure or junction box is thus exposed but the suspension cable that can be balancing a load such as a fixture remains in place. The exposure of the enclosure or junction box can facilitate the inspection of wiring, and in some instances, facilitate the adjustment of the wiring and wire connections without disconnecting the load. Preferably, the system and method can be manipulated without tools as the slip-ring and cable coupler can be fastened and unfastened by hand. While many of the systems and methods have been described through threaded joint embodiments, many other connecting alternatives are also encompassed within alternative embodiments. Such alternatives can include but are not limited to slotted channels, shaft and pin connections, etc.

While some embodiments of the invention have been described, it should be apparent that many more embodiments and implementations are possible and are within the scope of this invention. It is intended that the foregoing detailed description be regarded as illustrative rather than limiting, and that it be understood that it is the following claims,including all equivalents, that are intended to define the spirit and scope of this invention.

What is claimed is:

1. A suspension system that balances an object by a cable, comprising:

a stop-sleeve coupled to an end of a cable;

a cable coupler comprising a hollow portion formed to permit the cable to pass there through and a proximal surface having an opening sized to restrict an axial movement of the stop-sleeve; and a slip-ring coupled to an outer circumference of the hollow portion at a distal end;

wherein a portion of the cable is axially aligned within the hollow portion and the stop-sleeve is axially aligned outside of the hollow portion.

2. The suspension system of claim 1 wherein the hollow portion comprises a first and a second hollow portion having different inner circumferences.

3. The suspension system of claim 2 wherein the first hollow portion comprises female spiral threads and the second hollow portion comprises smoothly curved surfaces.

4. The suspension system of claim 1 further comprising an enclosure within which electric circuits are connected and a stud, the stud being coupled to the cable coupler and the enclosure.

5. The suspension system of claim 1 wherein a stud, the stop-sleeve, and the cable are axially aligned within the hollow portion.

6. The suspension system of claim 1 wherein threads are formed on an outer portion of the cable coupler and form a threaded joint with the slip-ring.

7. The suspension system of claim 1 wherein the slip-ring has open ends of substantially equal diameters.

8. A suspension system that balances a fixture, comprising:

a cable;

a stop-sleeve coupled to a distal end of the cable;

a cable coupler comprising a stem formed to receive the cable and a surface having an opening sized to permit the cable to pass there through but restrict an axial movement of the stop-sleeve; the stem having an outer circumference smaller than a circumference of a mounting hole passing through a canopy; and a slip-ring coupled to an outer circumference of the stem at a distal end, the slip-ring having a larger circumference than the circumference of the mounting hole of the canopy;

wherein the canopy is coupled to a junction box by only the slip-ring.

9. The suspension system of claim 8 wherein the stem comprises a first hollow portion and a second hollow portion, the first hollowed portion being formed with spiral threads on an inner cylindrical surface and the second hollow portion being formed with smooth curved walls between the open ends of the second hollow portion.

10. The suspension system of claim 8 wherein the cable coupler further comprises uniform threads tapered around an entire outer surface of the stem of the cable coupler.

11. The suspension system of claim 8 wherein the slip-ring further comprises uniform threads tapered within an inner surface.

12. The suspension system of claim 8 wherein the surface having the opening sized to permit the cable to pass there through but restrict the axial movement of the stop-sleeve comprises an outer surface.

13. The suspension system of claim 8 wherein the surface having an opening sized to restrict the axial movement of the stop-sleeve is an inner surface.

14. A suspension system that balances a fixture, comprising:

a cable;

a stop-sleeve coupled to a distal end of the cable;

a cable coupler comprising a stem formed to receive the cable and a surface having an opening sized to Hermit the cable to pass there through but restrict an axial movement of the stop-sleeve; the stem having an outer circumference smaller than a circumference of a mounting hole passing through a canopy; and a slip-ring coupled to an outer circumference of the stem at a distal end, the slip-ring having a larger circumference than the circumference of the mounting hole of the canopy;

wherein the cable coupler further comprises threads tapered on separate outer portions of the stem having different circumferences.

* * * * *